US005392843A

United States Patent [19]

Dolan

[11] Patent Number: 5,392,843

[45] Date of Patent: Feb. 28, 1995

[54] CONTINUOUS SILVER FLOAT CASTING OF STEEL SHEET OR PLATE

[76] Inventor: James J. Dolan, 22 Laurel Oak, Amelia Island, Fla. 32034

[21] Appl. No.: 36,994

[22] Filed: Mar. 25, 1993

[51] Int. Cl.[6] ..... B22D 17/00; B22D 17/32

[52] U.S. Cl. ..... 164/485; 164/81; 164/440; 164/443; 164/490

[58] Field of Search ..... 164/81, 485, 486, 443, 164/444, 440, 490

[56] References Cited

U.S. PATENT DOCUMENTS

| | | | |
|---|---|---|---|
| 2,298,348 | 10/1942 | Coxe | 164/81 |
| 2,754,559 | 7/1956 | Fromson | 164/81 |
| 3,083,551 | 4/1963 | Pilkington | 65/32 |
| 3,853,523 | 12/1974 | Dickinson et al. | 65/99 |
| 4,955,430 | 9/1990 | Sherwood | 164/485 |

*Primary Examiner*—Kuang Y. Lin
*Attorney, Agent, or Firm*—Webb Ziesenheim Bruening Logsdon Orkin & Hanson

[57] ABSTRACT

An improvement in systems for continuous casting steel to near net shape sheet or plate directly from molten metal. This is accomplished by floating the liquid steel on a liquid substrate of silver, allowing it to solidify and withdrawing a continuous section of thin, wide steel. Liquid to liquid casting, by eliminating the mechanical problems of thin sheet casting with wheels or belts, allows for increased tonnage rates. For example, aiming at a thickness of 3 mm. by a width of 1500 mm., a liquid steel to liquid silver caster in continuous production at 200 feet per minute will produce 750,000 tons per annum. Increased cast speeds and/or multiple lines due to simple construction seem practicable for greater tonnage. Only liquid silver, as a float medium, makes high quality float casting of molten steel possible. The present invention combines the superior qualities of silver as a float medium for steel with an apparatus for introducing molten steel uniformly across a wide, thin section onto a U-shaped surface of molten silver so that the steel may freeze without bath turbulence to form a flat sheet or plate free of shape distortion and surface defects. Cooling of the bottom surface of the molten steel by heat transfer through the liquid silver and the subsequent heat exhaustion by means of a water cooled base—coupled with cooling the upper surface of the steel at high rates by recirculating heat exhausted inert atmosphere gas and by water spray cooling the casting chamber top—result in a casting speed which produces steel in a commercially viable tonnage range for continuous operation.

16 Claims, 4 Drawing Sheets

CONTINUOUS SILVER FLOAT CASTING OF STEEL SHEET OR PLATE

FIELD OF THE INVENTION

The invention has to do with the float casting of steel sheet or plate.

BACKGROUND OF THE INVENTION

Known continuous steel casting methods produce sections two inches (2") (50 mm.) or thicker by width by casting through solid water cooled copper molds in either a vertical or curved configuration. The main problem with such casting is that solid molds intrinsically have a potential for causing defects in cast steel, and thick slabs cast through solid molds to be reduced to sheet or plate must be reheated and rerolled on large, highly complex, energy inefficient equipment with high capital and operating costs.

The prior art is plagued not only by the technical problems and costs associated with slab casting but also by failures in recent world wide initiatives in thin sheet or plate casting. These have consisted of flowing liquid steel by pour and meniscus over mechanical water cooled rolls either single or double roll configuration or alternately casting molten steel between two continuous water cooled moving belts. The major problems with these methods are 1) the poor surface quality resulting from the mechanical impingement of rolls or belts on the liquid steel; 2) the containment of a liquid steel pool between mechanical rolls or belts and 3) shell sticking caused by free meniscus overflow.

A further initiative on near net shape sheet or plate casting is the approach of levitating a thin molten steel section in a super high energy electromagnetic field until it freezes, but this method is ubiquitously recognized as totally cost ineffective.

One known method of float casting liquid steel likewise has known disadvantages. U.S. Pat. No. 4,955,430 to Sherwood discloses float casting molten steel on a molten lead substrate. The question of the immiscibility of lead with iron becomes moot in practice: the vapor pressure of molten lead is so high that at 1600° C. a violent boiling action drives lead into and even through the cast liquid steel as it freezes, entraining large particles of lead (1 to 2 cm.) in and on the surface of the steel. In addition, intense fuming of lead at these temperatures creates an insurmountable environmental problem.

A need remains, therefore, for a float method for casting liquid steel which gives satisfactory sheet casting without the energy inefficiency and inferior quality characteristic of prior art processes.

SUMMARY OF THE INVENTION

In order to meet this need, the invention is an improvement in systems for continuous casting steel to near net shape sheet or plate directly from molten metal. This is accomplished by floating the liquid steel on a liquid substrate of silver, allowing it to solidify and withdrawing a continuous section of thin, wide steel. Liquid to liquid casting, by eliminating the mechanical problems of thin sheet casting with wheels or belts, allows for increased tonnage rates. For example, aiming at a thickness of 3 mm. by a width of 1500 mm., a liquid steel to liquid silver caster in continuous production at 200 feet per minute will produce 750,000 tons per annum. Increased cast speeds and/or multiple lines due to simple construction seem practicable for greater tonnage.

Only liquid silver, as a float medium, makes high quality float casting of molten steel possible. The present invention combines the superior qualities of silver as a float medium for steel with an apparatus for introducing molten steel uniformly across a wide, thin section onto a U-shaped surface of molten silver so that the steel may freeze without bath turbulence to form a flat sheet or plate free of shape distortion and surface defects. Cooling of the bottom surface of the molten steel by heat transfer through the liquid silver and the subsequent heat exhaustion by means of a water cooled base—coupled with cooling the upper surface of the steel at high rates by recirculating heat exhausted inert atmosphere gas and by water spray cooling the casting chamber top—result in a casting speed which produces steel in a commercially viable tonnage range for continuous operation.

DETAILED DESCRIPTION OF THE INVENTION

Figure 1:
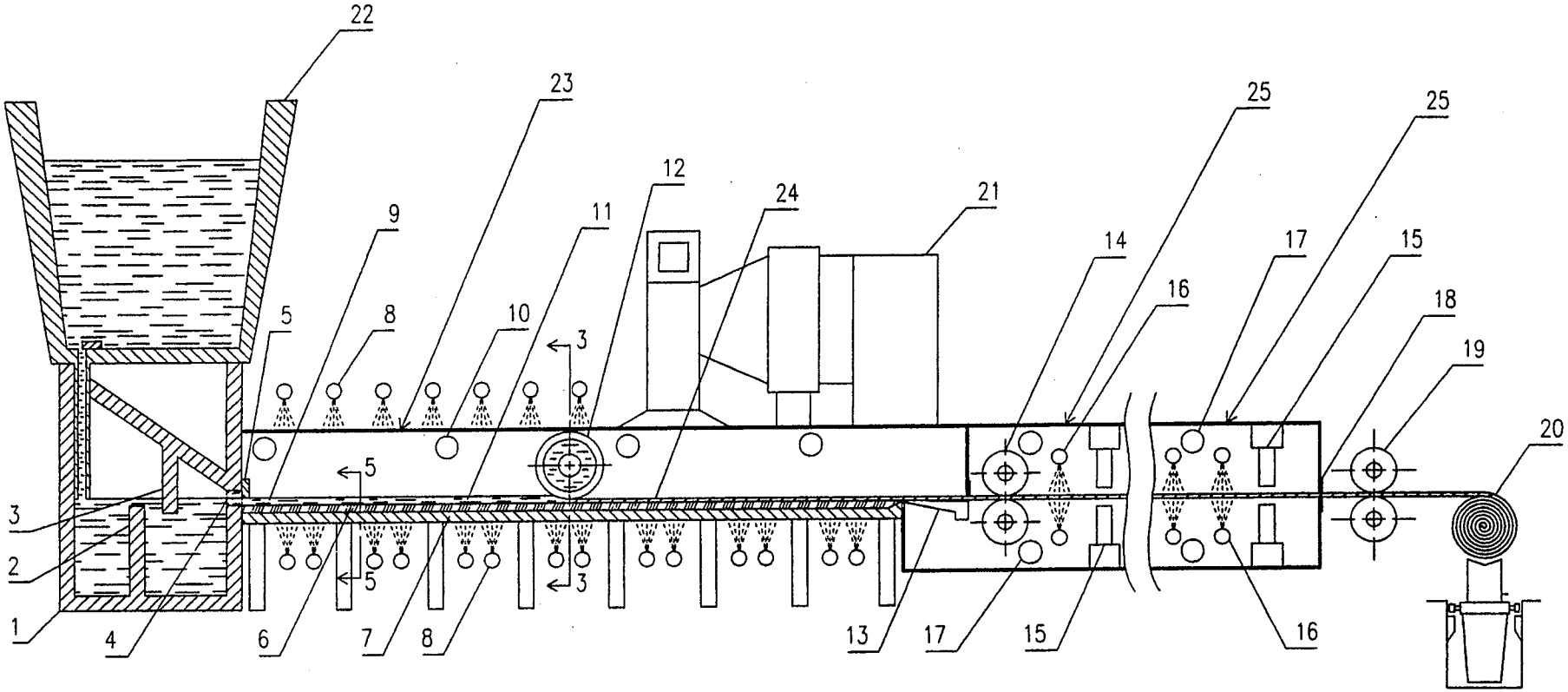
FIG. 1 is a diagrammatic longitudinal side elevational view illustrating the method and apparatus of this invention wherein molten steel is float cast on molten silver.

The present invention is an improvement in systems for continuous casting steel to near net shape sheet or plate directly from molten metal. This is accomplished by floating the liquid steel on a U-shaped liquid substrate of silver, allowing it to solidify and withdrawing a continuous section of thin, wide steel. Liquid to liquid casting, by eliminating the mechanical problems of thin sheet casting with wheels or belts, allows for increased tonnage rates. For example, aiming at a thickness of 3 mm. by a width of 1500 mm, a liquid steel to liquid silver caster in continuous production at 200 feet per minute will produce 750,000 tons per annum. Increased cast speeds and/or multiple lines due to simple construction seem practicable for greater tonnage.

Only liquid silver, as a float medium, makes high quality float casting of molten steel possible. The present invention combines the superior qualities of silver as a float medium for steel with an apparatus for introducing molten steel uniformly across a wide, thin section onto a U-shaped surface of molten silver so that the steel may freeze without bath turbulence to form a flat sheet or plate free of shape distortion and surface defects. Cooling of the bottom surface of the molten steel by heat transfer through the liquid silver and the subsequent heat exhaustion by means of a water cooled base—coupled with cooling the upper surface of the steel at high rates by recirculating heat exhausted inert atmosphere gas and by water spray cooling the casting chamber top—result in a casting speed which produces steel in a commercially viable tonnage range for continuous operation.

By "U-shaped," a structure is meant having a generally horizontal base and two generally vertical sides. In ordinary practice the horizontal to vertical ratio of the "U" will be quite high—on the order of 16:1 or more—but the term "U-shaped" has been selected as the best term available to describe this shape.

The apparatus of the present invention includes a casting chamber requiring no independent source of heat, characterized by minimal thermal inertia and capable of rapid shut down and restarting. Inbound molten steel to the casting chamber at 1600° C. will instantly liquify even ambient temperature silver because of the 961° C. melting point of silver. As a result, the casting chamber need not be heated by anything other than the ingress of the molten steel.

The high density of molten silver compared to the density of liquid steel dictates a very shallow bath of silver (less than about 1 inch) and because of silver's total immiscibility to steel the bath of silver requires no additions. The shallow bath in the casting chamber without internal heating requirements means the chamber may be built up of low cost modular units, for example sheet iron ductwork simply insulated against heat radiation and light structural members, the weight in tons of this float casting chamber being very low. Moreover, the low compact design of the casting chamber allows for the cooled inert gas atmosphere to be introduced into the chamber headspace for rapid travel over the top free surface of the advancing steel thus increasing the system efficiency and reducing the volume of gas required. The invention contemplates a casting chamber which may be maintained in service for maximum periods of time without costly shut-downs when interruptions or break-downs occur.

A preferred embodiment of the invention incorporates a tundish from which the molten steel flows smoothly and uniformly onto the surface of the molten silver with minimal or no turbulence or splashing. The tundish close coupled to the atmosphere entry seal of the casting chamber contains a reservoir for molten steel, an integral dam over which this molten steel flows, a ceramic foam filter (known in the art) to break up the stream of molten steel in order further to reduce turbulence in the stream and a laser controlled spillway to deliver a prescribed thickness of liquid steel onto the liquid silver surface of the casting chamber. The spillway spans the casting chamber from edge to edge transversely and delivers a previously filtered non-turbulent molten stream horizontally, at very low angle (15–25 degrees from the horizontal) across the entire front of the liquid silver bath.

It is known that a buoyant body of liquid steel will automatically achieve a condition of stable thickness when equilibrium has been established between the forces of surface tension and the forces of gravity. While it has been shown by others that free pouring molten steel onto an unbound surface will result in a thickness of approximately 6 mm., the thickness may be adjusted either by withdrawing the shell from the pool at a rate which prevents complete solidifications of the pool or by a gentle squeezing of the solidifying shell by a water cooled top roll mounted in the casting chamber or alternately by a series of vertical rolls edge mounted top and bottom on each surface at the edges to reduce thickness. Edge and/or top rolling synchronized with withdrawal rate lowers the surface tension of the as cast molten steel, which is approximately 1500 [ERG/cm$^2$], yielding silver float casting sections with thickness substantially below 6 mm. For example, 3 mm. steel thicknesses can be achieved in this way by the edge and/or top rolling's reducing the steel thickness by half.

The method and apparatus of this invention provide:

a) a continuous method and machinery for casting steel sections with substantial width to thickness ratio;

b) a casting substrate medium, liquid silver, which allows such steel sections to be float cast, thus eliminating solid mold friction and/or wheel or belt cast containment problems which result in poor surface, edge cracking and reoxidation;

c) a low capital, simple non-heated casting chamber;

d) a method and apparatus for introducing uniform low turbulence molten steel onto a liquid silver bath;

e) top surface and/or edge rolling to reduce surface tension and to enable a substantial thickness range of sections beyond equilibrium to be cast;

f) an environmentally sound process for continuous production of steel sheet or plate of good surface and internal quality; and g) the immiscibility of silver with various grades of carbon, stainless and electrical steels allows for float casting a range of liquid steels on a dense, stable, non-wetting molten bath of silver.

Referring now to FIG. 1, the molten steel is poured from a bottom poured, slide gate ladle 22 into a liquid steel reservoir 1 containing a baffle and weir 2 and 3. The liquid steel passes through a ceramic foam filter 4 and across a laser controlled spillway 5 to float on the surface of a liquid silver pool 6 contained within a holding mold 7 mounted in the casting chamber. The liquid steel 9 floats on the liquid silver and heat is rapidly exhausted from the bottom surface by high volume, externally piped water sprays 8 in purging on the mold tray holding the silver 7. Heat is exhausted from the top surface by recirculating cooled Argon gas under positive pressure piped into the casting chamber 23 through pipes and headers 10 in the sidewall and an external heat exchanger 21. Computer controlled water sprays 8 also exhaust heat directly from the steel of the casting chamber 23. A solidified surface shell 24 is rapidly formed, advancing to a water cooled top roll 12 where thickness is reduced and in synchronization the elongated steel sheet or plate is advanced to and through an air knife 13 at the exit seal of the casting chamber which strips liquid silver back into the bath and thence through withdrawal pinch rolls 14 to a forced cooling section 25. Within the forced cooling section 25 top and bottom computer controlled water sprays 16 remove heat directly from steel surfaces while cooled, recirculating Argon gas under positive pressure is pumped through headers 17. The continuously moving sheet in this section is levitated by electromagnetism 15 from a location below the curie point (770° C.) to minimize mechanical contact on steel surfaces. When advancing steel is below oxidation temperature, it is withdrawn by exit pinch rolls 19 through an atmosphere seal 18 in the cooling chamber 24 and is wrapped in a continuous coil by a tension recoiler 20.

Figure 2:
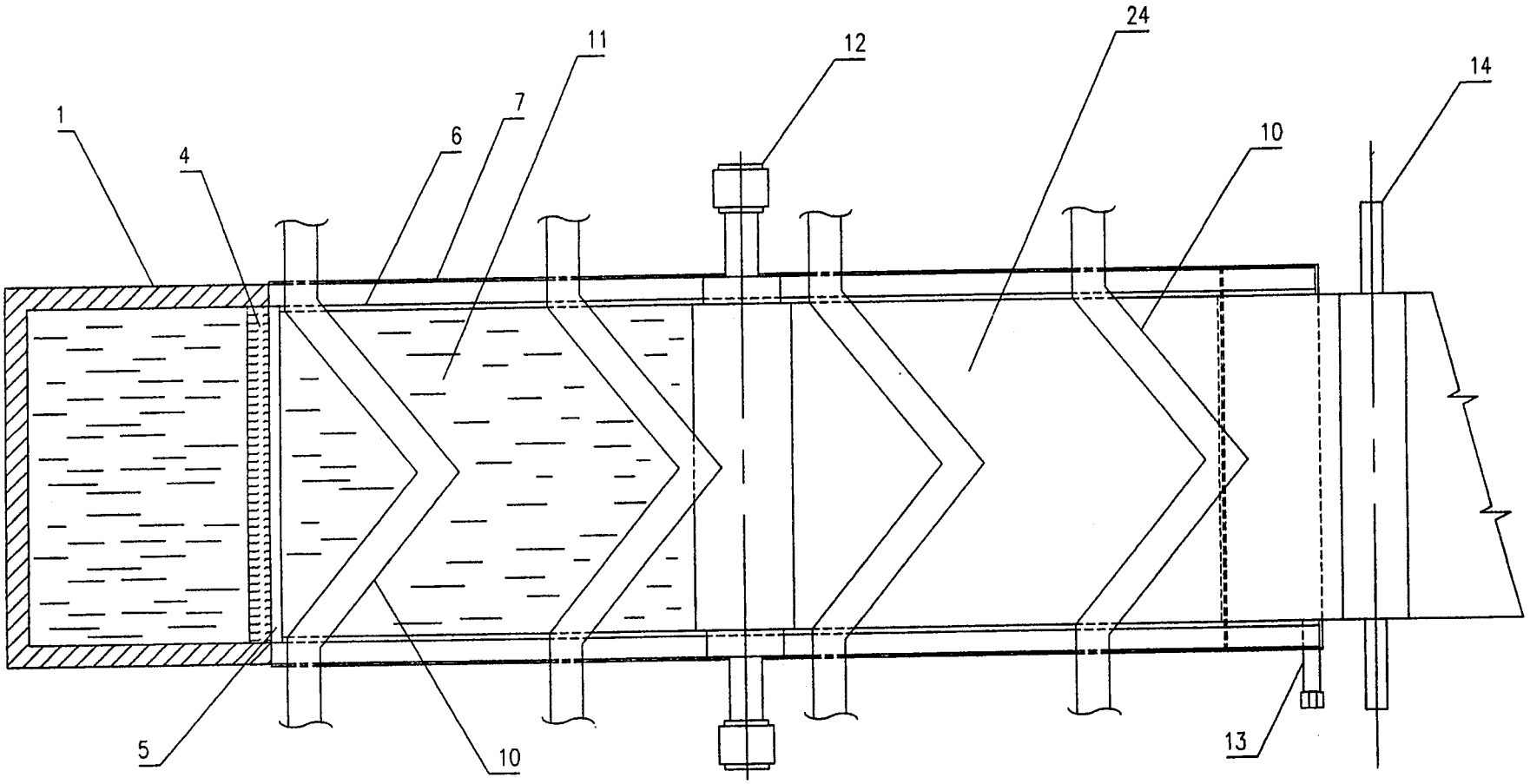
FIG. 2 is a plan view of the casting chamber and the molten silver bath of FIG. 1.

Referring now to FIG. 2, the chevron arrangement for the forced atmosphere header pipes are shown 10 in the headspace of the casting chamber shell 23 as well as the flow of the molten steel 9 from the tundish 1 through the ceramic foam filter 4 and over the laser controlled spillway 5 onto the liquid silver bath 6.

Figure 3:
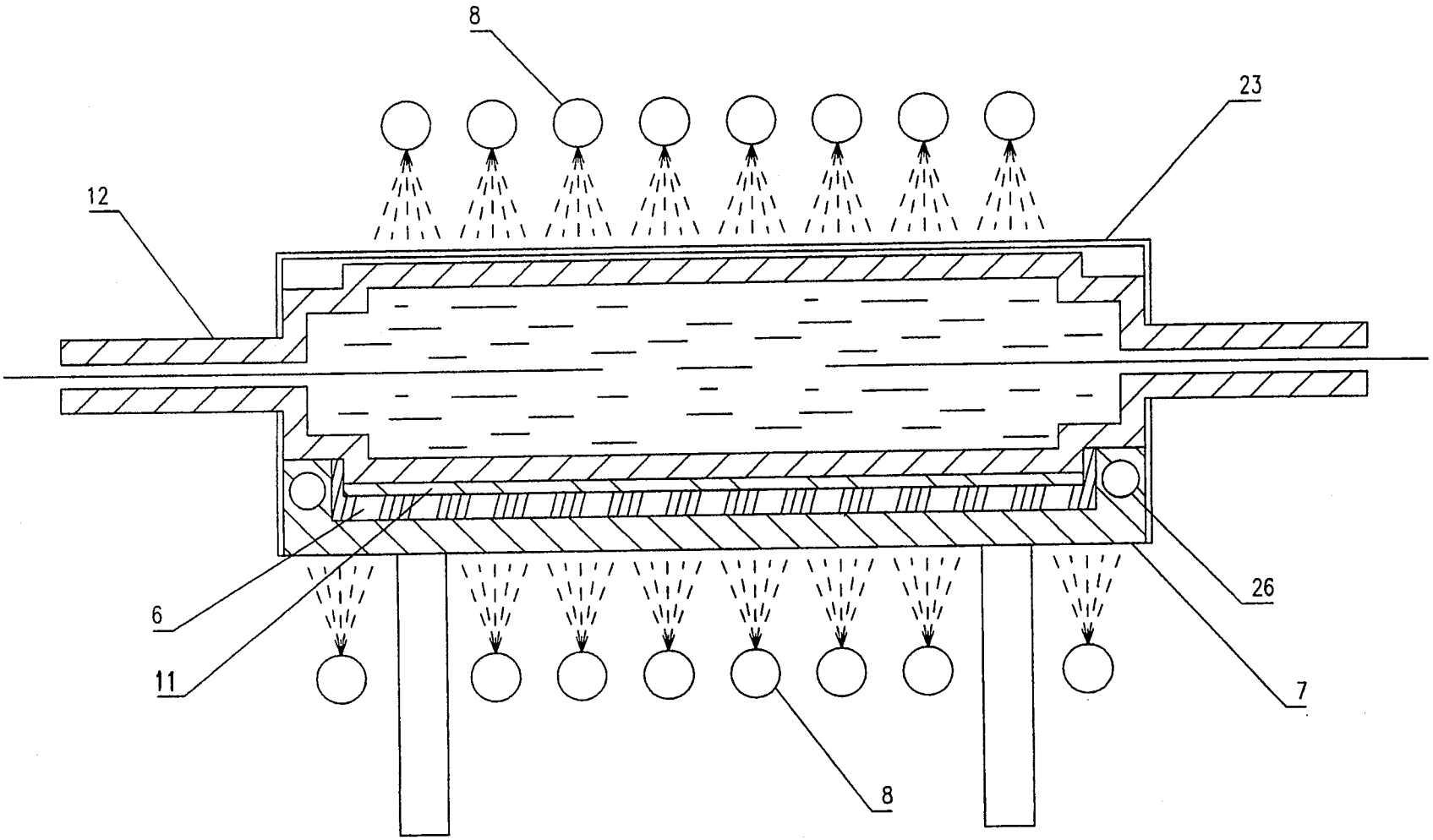
FIG. 3 is a cross section end view of the casting chamber along lines 3—3 of FIG. 1.

Referring to FIG. 3, the U-shaped cast iron or steel shell for the molten silver 7 is shown filling the casting chamber 23 and allowing silver to seat vertically at the edges of the mold so as to maintain a liquid silver interface with the edges as well as the bottom surface of the steel 9 as it freezes. Water sprays 8 impinge directly on steel mold containing silver 7 to exhaust heat rapidly. The water cooled top roll 12 is shown mounted in casting chamber by external pillow block arrangement through the sidewalls of the chamber 23 and cooled by an external rotary water connection.

Although theoretically the first time the casting chamber 23 is used it could be filled with silver ingot and a bath formed after the first run with molten steel, as a practical matter it is better to have the U-shaped silver slab fabricated in advance by a silver fabricator. The U-shaped silver slab thus has edge dams along its sides, and the U-shaped silver slab fits precisely within the U-shaped mold. (The mold will usually if not always be U-shaped so as to include cooling means within the sides of the mold to cool the edge dam portions of the U-shaped silver bath—see FIG. 5 and the discussion below.) Consonant with the description supra., once the U-shaped silver slab is in place, all that is necessary to create a molten silver interface between the silver slab and the molten steel is the charging of the molten steel to the mold. Although the silver bath may be completely molten, preferably the present silver bath includes a solid layer beneath the molten silver layer, for optimized heat exchange.

Figure 5:
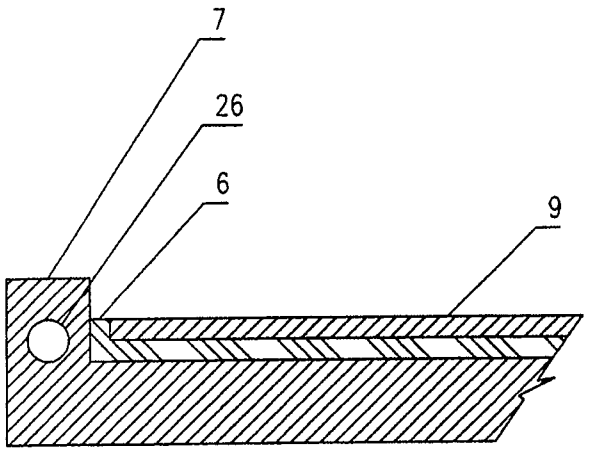
FIG. 5 is a cross section of the mold and the silver bath contained therein along lines 3—3 of FIG. 1.
Figure 4:
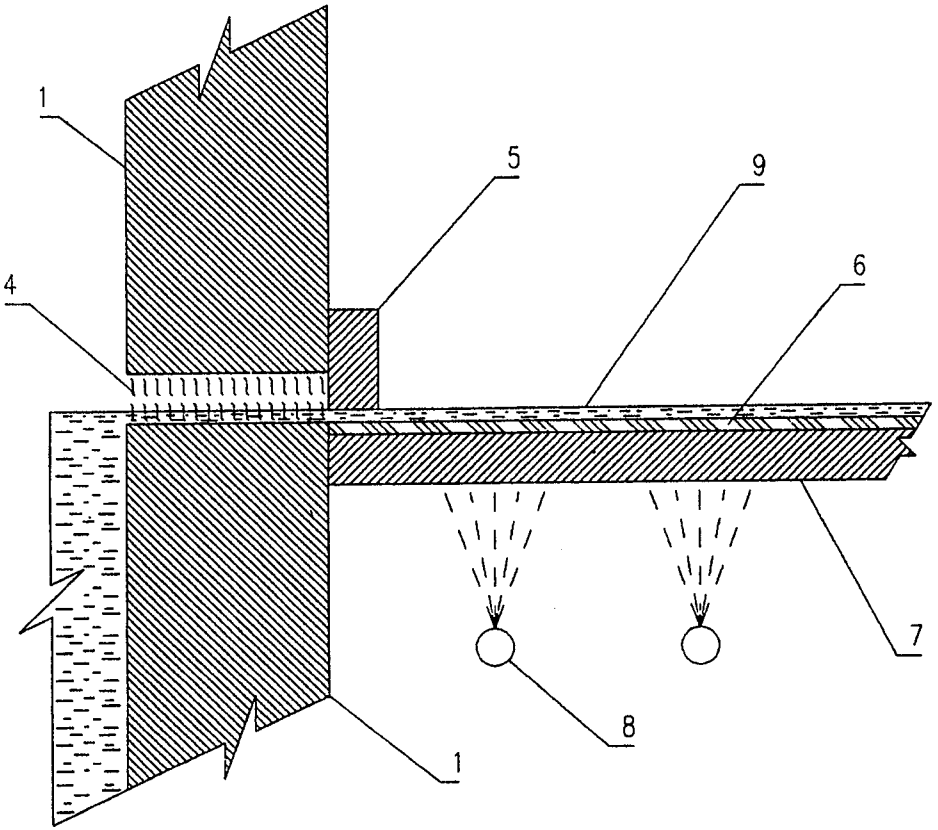
FIG. 4 is a cross section of the molten steel spillway and gate along lines 5—5 of FIG. 1.

Referring to FIG. 4 and FIG. 5, cross sections of the molten steel feeding tundish 1 are shown demonstrating placement of the ceramic foam filter 4 and the laser controlled spillway 5 which meters the molten steel 9 uniformly onto the surface of the molten silver 6. The cross section of the mold containing the silver bath 7 shown in FIG. 5 indicates independently piped water cooling in the edges of the mold 26 so as to maintain a different temperature at its edges of the solidifying steel than through the main body of the steel so as to maintain proper shape of the high width to thickness ratio of the steel.

In summary, the present invention is a method and apparatus for the horizontal casting of a continuous stream of liquid steel onto the liquid surface of a bath of molten silver and cooling of the steel while freezing to form a continuous sheet or plate with high width to thickness ratio. The liquid steel contacts only liquid silver while freezing. The liquid on liquid approach to casting thin section steel sheet or plate allows greatly increased rates of production for carbon, stainless or electrical steels. Silver is totally immiscible with steel at 1600° C., and has a 20% higher density than steel at that temperature allowing the liquid steel to float on the liquid silver. Moreover silver has a lower melt point than steel, a higher boiling point than steel and a very low vapor pressure so as to form in its liquid state a stable, non-turbulent float media. Silver is the best heat conductor of all metals and steel and silver are non-wetting to each other. Liquid steel will flow approximately half the viscosity of liquid silver. This enables the molten steel to move across the liquid silver and to freeze before any mechanical contact is made with either top or bottom surface. A preferred embodiment involves an elongated casting chamber containing a plate of silver, the surface of which will instantly liquify to liquid steel due to the 600° C. difference in melting temperatures. Liquid steel from a prior process is introduced to float on the molten silver while keeping the silver interface liquid by virtue of the temperature differential. The silver bath is confined in a steel or cast iron mold which is externally cooled by a plurality of computer controlled water sprays impinging on the bottom of the mold and cooling the silver at a determined rate as it exhausts heat from the molten steel. The head space top shell of the casting chamber is also cooled by water spray. The casting chamber is ordinarily sealed at its entry and exit ends to confine an inert gas atmosphere such as Argon to prevent oxidation and to aid in cooling the steel as it freezes. The hot atmosphere gas is exhausted, cooled through a conventional heat exchanger and recirculated. A top mounted water cooled roll may be mounted in the casting chamber, so that the top mounted water cooled roll imparts a gentle squeezing pressure to the solidifying steel at a point in the casting chamber where the steel is just below the (gamma) transformation stage of the steel (1175° C.). An outer shell solidification front is formed as the steel freezes and continues to solidify as it is gently pressured by a water cooled roll to refine the "free" top surface, adjust thickness, and by traction to move the solidifying steel to withdrawal rolls mounted at the end of the casting chamber. An "air knife" mounted at the exit seal strips liquid silver carried by steel drag effect back to the molten silver bath. The freely floating body of molten steel at the entry of the casting chamber has its edges defined by the silver edge dams matched to or exceeding the steel thickness. The bottom and edge surfaces of the steel are thus in contact only with liquid silver while the steel freezes, the top surface being free.

The following Example is further illustrative of the present invention. The Example is admittedly prophetic and has been drafted in the past tense for readability only. The spectroscopy data were generated as a part of a small scale trial conducted at the Carnegie-Mellon University Metallurgical Laboratory in Pittsburgh, Pa.

EXAMPLE

An apparatus was assembled according to FIG. 1 and an 1800 oz. U-shaped silver slab from a silver fabricator was fitted into the holding mold 7. Liquid steel was poured from a bottom poured, slide gate ladle 22 into a liquid steel reservoir 1 containing a baffle and weir 2 and 3. The liquid steel passed through a ceramic foam filter 4 and across a laser controlled spillway 5 to float on the surface of a liquid silver pool 6 contained within the holding mold 7 mounted in the casting chamber. The liquid steel 9 floated on the liquid silver and heat was rapidly exhausted from the bottom surface by high volume, externally piped water sprays 8 in purging on the mold tray holding the silver 7. Heat was exhausted from the top surface by recirculating cooled Argon gas under positive pressure piped into the casting chamber 23 through pipes and headers 10 in the sidewall and an external heat exchanger 21. Computer controlled water sprays 8 also exhausted heat directly from the steel of the casting chamber 23. A solidified surface shell 24 was rapidly formed, advancing to a water cooled top roll 12 where thickness was reduced and in synchronization the elongated steel sheet or plate was advanced to and through an air knife 13 at the exit seal of the casting chamber which stripped liquid silver back into the bath and thence through withdrawal pinch rolls 14 to a forced cooling section 25. Within the forced cooling section 25 top and bottom computer controlled water sprays 16 removed heat directly from steel surfaces while cooled, recirculating Argon gas under positive pressure was pumped through headers 17. The continuously moving sheet in this section was levitated by electromagnetism 15 from a location below the curie point (770° C.) to minimize mechanical contact on steel surfaces. When the advancing steel was below oxidation temperature, it was withdrawn by exit pinch rolls 19 through an atmosphere seal 18 in the cooling chamber 24 and was wrapped in a continuous coil by a tension recoiler 20.

The cast steel was examined using a scanning electron microscope and no detectable amount of Ag was found even in the matrix of the Fe phase at the Ag/Fe interface. Thus, silver and steel are totally immiscible in the practice of this invention.

Although the invention has been described with particularity above, variations may be made to my disclosure without departing from the essence of it and therefore the invention is to be limited only insofar as it is set forth in the accompanying claims.

I claim:

1. A method of manufacturing carbon, stainless or electrical steel sheet or plate, completely free of entrained silver, having a high width-to-thickness ratio which comprises the steps of:

a) fabricating a U-shaped silver slab and fitting said slab into a cooled mold within an oxygen purged casting chamber;

b) delivering liquid steel at at least about 1600° C. at a controlled rate onto said silver slab, to create a steel-silver interface in which the silver at the interface is molten and has a temperature of at least about 1600° C., with total immiscibility of the steel and the silver at that interface; and c) advancing said steel along said slab and cooling said steel by withdrawing heat through said cooled mold and further by recirculating inert gas over the upper surface of said liquid steel, followed by forced cooling by computer controlled top and-bottom mounted water spray and a recirculating, cooled atmosphere.

2. The method according to claim 1 wherein said liquid steel is baffled within a holding reservoir to minimize turbulence from inbound steel feed, with further minimization of turbulence by passing said liquid steel through a ceramic foam filter mounted at the crest of a spillway horizontal to the entire width of said molten silver at the interface, which spillway is flow controlled by a laser activated metering dam.

3. The method according to claim 1 wherein said liquid steel is further laterally aligned on said molten silver at the interface by means of silver edge dams, said edge dams forming the upright portions of said U-shaped slab and being independently water cooled by external piping.

4. The method according to claim 1 wherein said cooled mold has a plurality of exterior spray heads containing water by which said bath is cooled.

5. The method according to claim 1 wherein said recirculating inert gas is introduced under positive pressure into a head space within said casting chamber, in the direction of the advancing body of liquid steel, followed by recirculating of the gas through an external heat exchanger.

6. The method according to claim 1 wherein said advancing liquid steel is squeezed with a top mounted water cooled roll, which imparts a gentle squeezing pressure to the solidifying steel at a point in the casting chamber just below the (gamma) transformation stage of the steel (1175° C.).

7. The method according to claim 1 for recirculating said molten silver at the interface by mounting a pressure header or air knife horizontally across said molten silver at its termination to strip back into said molten silver any liquid silver moving forward by drag effect from said liquid steel.

8. The method according to claim 6 wherein after said advancing liquid steel is squeezed with a top mounted water cooled roll, said steel is further cooled by supporting it magnetically through a forced atmosphere and spraying water both on top and on the bottom of said steel, during the period when the steel cools from below the curie point (770° C.) until the time it passes through withdrawal rolls mounted horizontally at the exit seal, where said steel emerges.

9. An apparatus for the continuous silver float casting of steel in which the steel contains no entrained silver, comprising: a U-shaped mold; a U-shaped solid silver slab supported by said U-shaped mold for allowing a layer of molten steel to float on the surface thereof to create a steel-silver interface in which the silver at the interface is molten and has a temperature of at least about 1600° C. and the remaining portion of the silver slab remains solid; said silver slab including solid edge dams of silver held substantially vertically by said U-shaped mold; a metering gate located at one end of said U-shaped mold for continuously flowing said layer of steel onto the surface of said U-shaped silver slab having molten silver on the surface thereof; and an enclosed casting chamber enclosing at least a part of said U-shaped mold, said chamber having a plurality of walls.

10. The apparatus according to claim 9 wherein a liquid steel reservoir is located upstream of said U-shaped mold, with said liquid steel reservoir having baffles therein.

11. The apparatus according to claim 10 wherein said reservoir has a spillway and said spillway is positioned adjacent a ceramic foam filter, said ceramic foam filter further having a plurality of orifices and extending horizontally across the width of the casting chamber.

12. The apparatus according to claim 11 wherein said spillway has a crest and said spillway is provided with a laser controlled gate mounted horizontally at said crest.

13. The apparatus according to claim 12 wherein said edge dams are provided with adjacent independent cooling pipes.

14. The apparatus according to claim 9 wherein a plurality of computer controlled water sprays are mounted externally to said slab so as to effect cooling of the bottom surface of said layer of steel by conduction.

15. The apparatus according to claim 14 wherein said casting chamber has a head space over said layer of steel, further wherein said head space has associated means for introducing cooled inert atmosphere gas to said head space, and further wherein said means for introducing cooled inert atmosphere gas is connected to ductwork connected to a conventional heat exchanger.

16. The apparatus according to claim 15 wherein said casting chamber has immediately adjacent thereto a cooling chamber, said cooling chamber having mounted therein a plurality of electromagnets to suspend said layer of steel.

* * * * *

UNITED STATES PATENT AND TRADEMARK OFFICE

CERTIFICATE OF CORRECTION

PATENT NO. : 5,392,843

DATED : February 28, 1995

INVENTOR(~~S~~) : James J. Dolan

It is certified that error appears in the above-indentified patent and that said Letters Patent is hereby corrected as shown below:

Claim 1 Line 39 Column 7 "and-" should read --and --.

Signed and Sealed this

Sixth Day of June, 1995

*Attest:*

*Attesting Officer*

BRUCE LEHMAN

*Commissioner of Patents and Trademarks*